US009766032B1

(12) United States Patent
Chang

(10) Patent No.: US 9,766,032 B1
(45) Date of Patent: Sep. 19, 2017

(54) MULTIPLY SECURED CROSSBOW

(71) Applicant: Combis Sport Enterprise Co., Ltd., Taichung (TW)

(72) Inventor: Chu-Wei Chang, Taichung (TW)

(73) Assignee: Combis Sport Enterprise Co., Ltd., Taichung (TW)

( * ) Notice: Subject to any disclaimer, the term of this patent is extended or adjusted under 35 U.S.C. 154(b) by 0 days.

(21) Appl. No.: 15/371,294

(22) Filed: Dec. 7, 2016

(51) Int. Cl.
*F41B 5/12* (2006.01)

(52) U.S. Cl.
CPC ..... *F41B 5/12* (2013.01)

(58) Field of Classification Search
CPC ..... F41B 5/12
See application file for complete search history.

(56) References Cited

U.S. PATENT DOCUMENTS 5,085,200 A * 2/1992 Horton-Corcoran . F41B 5/1469 124/25
5,215,069 A * 6/1993 Liu ..... F41B 5/12 124/25
5,598,829 A * 2/1997 Bednar ..... F41A 17/28 124/25
7,588,022 B2 * 9/2009 Chang ..... F41B 5/123 124/25
7,770,567 B1 * 8/2010 Yehle ..... F41A 17/46 124/25
8,522,761 B1 * 9/2013 Chu ..... F41A 17/46 124/25
2012/0048252 A1 * 3/2012 Chu ..... F41B 5/12 124/25

FOREIGN PATENT DOCUMENTS

TW 207344 6/1993

* cited by examiner

*Primary Examiner* — John Ricci
(74) *Attorney, Agent, or Firm* — Alan D. Kamrath; Kamrath IP Lawfirm, P.A.

(57) ABSTRACT

A crossbow includes a supporting unit, a bow, a string-pulling unit, a trigger unit, a sight and a security unit. The security unit includes a lock, a lock-biasing spring and a pusher. The sight includes an unlocking window. The lock is movable in the sight corresponding to the unlocking window between a locking position and an unlocking position. In the unlocking position, the lock prevents the trigger unit from pivoting. The lock-biasing spring is inserted in the sight and adapted for pivoting the lock to the locking position. The pusher is connected to the string-pulling unit and hence movable relative to the supporting between two positions through the unlocking window. In the first position, the pusher keeps the lock in the unlocking position. In the second position, the pusher allows the lock-biasing spring to move the lock to the locking position.

19 Claims, 14 Drawing Sheets

MULTIPLY SECURED CROSSBOW

BACKGROUND OF INVENTION

1. Field of Invention

The present invention relates to a crossbow and, more particularly, to a crossbow with multiple primary security units that are automatically activated during the loading of a bolt and that cannot be relieved until the bolt is properly loaded and ready for projection.

Related Prior Art

Taiwanese Patent No. 207344 discloses a crossbow that includes a barrel 10, a wing (not shown) transversely connected to a front portion of the barrel 10, a string (not shown) connected to the wing at two ends, a string-pulling unit 14 supported on the barrel 10, and a trigger 16 connected to the barrel 10. The string-pulling unit 14 is operable to pull the string to a tight, stressed or loaded status. The trigger 16 is operable to lock or release the string. The string-pulling unit 14 is a substantially U-shaped element made by bending a metal wire or a metal strip. The string-pulling unit 14 includes two branches each including a crook end 141 for hooking the string.

The use of this typical crossbow is not without any problem. For example, the user could project a bolt by mistake while loading the bolt onto the crossbow. Such accidental projection of the bolt imposes danger on the user and nearby people.

Some crossbows are provided with security units. However, such a security unit cannot be activated until the string of a crossbow is pulled and hooked by the trigger of the crossbow. Such a security unit is not automatically activated. A user could easily forget to activate the security unit. Hence, the security unit does not ensure the security of the user or nearby people.

The present invention is therefore intended to obviate or at least alleviate the problems encountered in the prior art.

SUMMARY OF INVENTION

It is the primary objective of the present invention to provide a crossbow that is automatically locked during the loading of a bolt and that cannot be released until the bolt is properly loaded.

To achieve the foregoing objective, the crossbow includes a supporting unit, a bow supported on the supporting unit, a string-pulling unit pivotally connected to the supporting unit and adapted for pulling the bow, a trigger unit connected to the supporting unit and adapted for restraining the bow, a sight supported on the supporting unit, and a security unit for restraining the trigger unit. The security unit includes a sight, a lock, a lock-biasing spring and a pusher. The sight includes an unlocking window. The lock is movable in the sight corresponding to the unlocking window between a locking position and an unlocking position. In the unlocking position, the lock prevents the trigger unit from pivoting. The lock-biasing spring is inserted in the sight and adapted for pivoting the lock to the locking position. The pusher is connected to the string-pulling unit and hence movable relative to the supporting between two positions through the unlocking window. In the first position, the pusher keeps the lock in the unlocking position. In the second position, the pusher allows the lock-biasing spring to move the lock to the locking position.

Other objectives, advantages and features of the present invention will be apparent from the following description referring to the attached drawings.

BRIEF DESCRIPTION OF DRAWINGS

The present invention will be described via detailed illustration of two embodiments referring to the drawings, wherein.

DETAILED DESCRIPTION OF EMBODIMENTS

Figure 1:
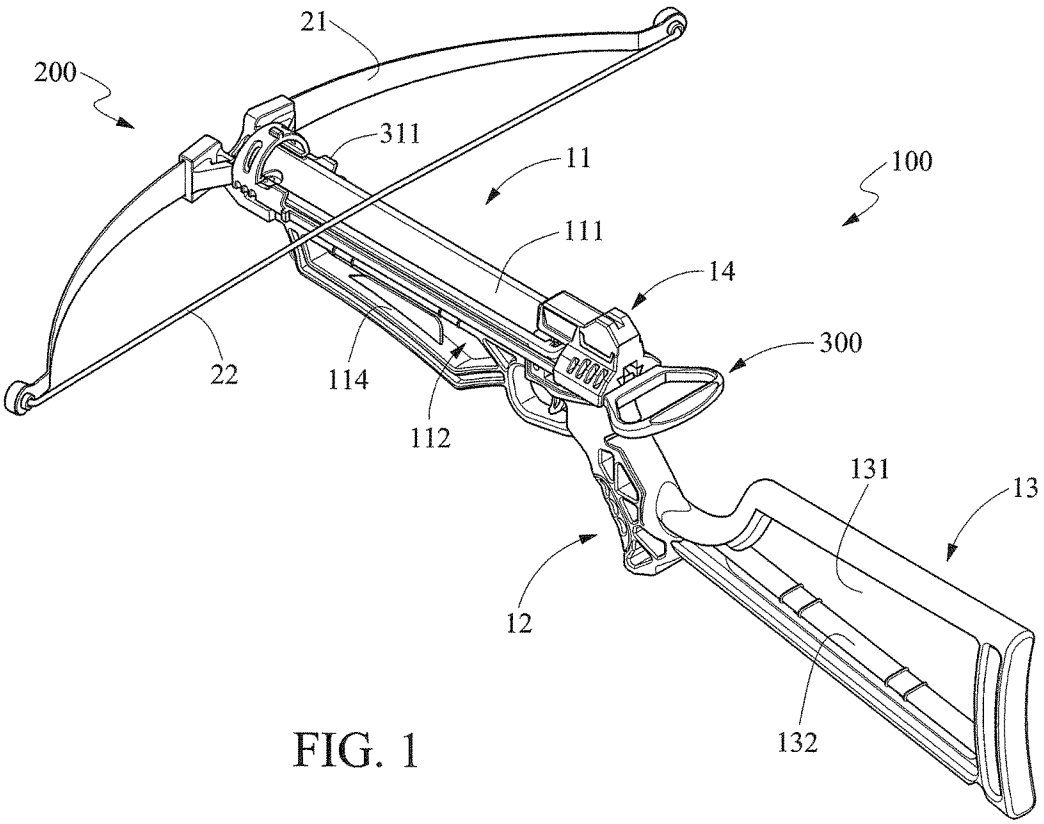
FIG. 1 is a perspective view of a crossbow according to the first embodiment of the present invention.
Figure 2:
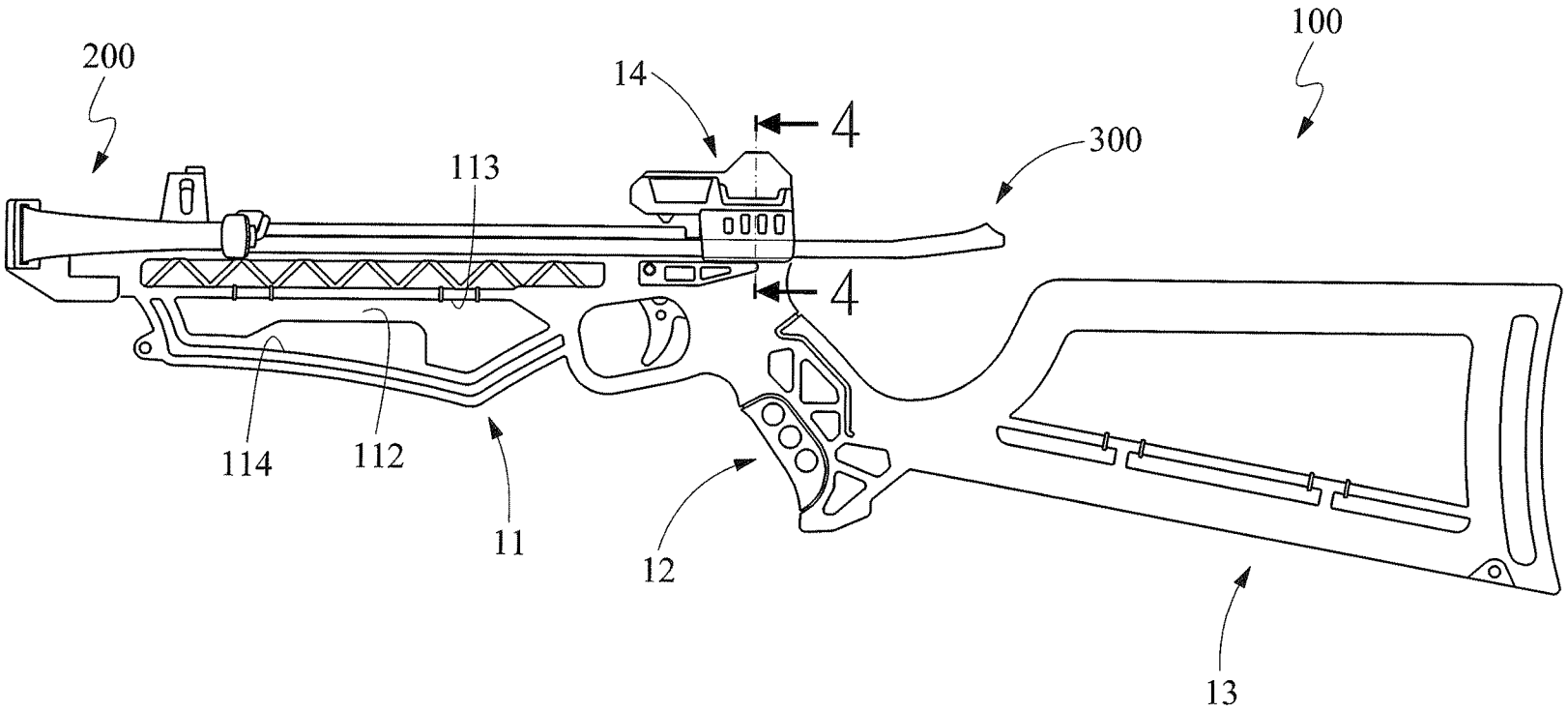
FIG. 2 is a side view of the crossbow shown in FIG. 1.

Referring to FIGS. 1 through 10, there is a crossbow according to a first embodiment of the present invention. The crossbow includes a supporting unit 100, a bow 200, a string-pulling unit 300, a trigger unit 41 and two security units 42 and 43.

Referring to FIGS. 1 to 4, the supporting unit 100 includes a barrel 11, a handle 12, a stock 13 and a sight 14. Preferably, the barrel 11, the handle 12 and the stock 13 are made in one piece. However, they can be made separately and then connected to one another. The barrel 11 is an elongated portion of the supporting unit 100. The handle 12 extends from a lower face of a rear portion of the barrel 11. The stock 13 extends from a rear face of a lower portion of the handle 12.

The barrel 11 includes at least one flight groove 111, an opening 112 and two strips 113 and 114. The flight groove 111 is made longitudinally in an upper face of the barrel 11. The opening 112 is made in a lower portion of the barrel 11. Both of the strips 113 and 114 extend by the opening 112.

The handle 12 includes a dovetail 121, a slot 122, two longitudinal grooves 123 and a transverse groove 124. The dovetail 121 is formed on an upper portion of the handle 12, behind the flight groove 111. The slot 122 extends throughout the dovetail 121. Each of the longitudinal grooves 123 is made in a flank or lateral side of the dovetail 121. The transverse groove 124 is made in an upper face of the dovetail 121.

The stock 13 includes an opening 131 and a strip 132. The opening 131 is made in the stock 13, thereby providing a frame (not numbered) around the opening 131. The strip 132 includes two ends connected to two portions of the frame of the stock 13. Preferably, the frame of the stock 13 and the strip 132 are made in one piece.

The sight 14 includes a block 141, a dovetail groove 143, two shields 144, two grooves 145, a slit 146 and a space 149. The dovetail groove 143 is made in a lower face of the block 141. The shields 144 extend from the lower face of the block 141. The dovetail groove 143 is located between the shields 144. Each of the grooves 145 is made in an internal side of a corresponding one of the shields 144. The space 149 is made in the lower face of the block 141.

Figure 8:
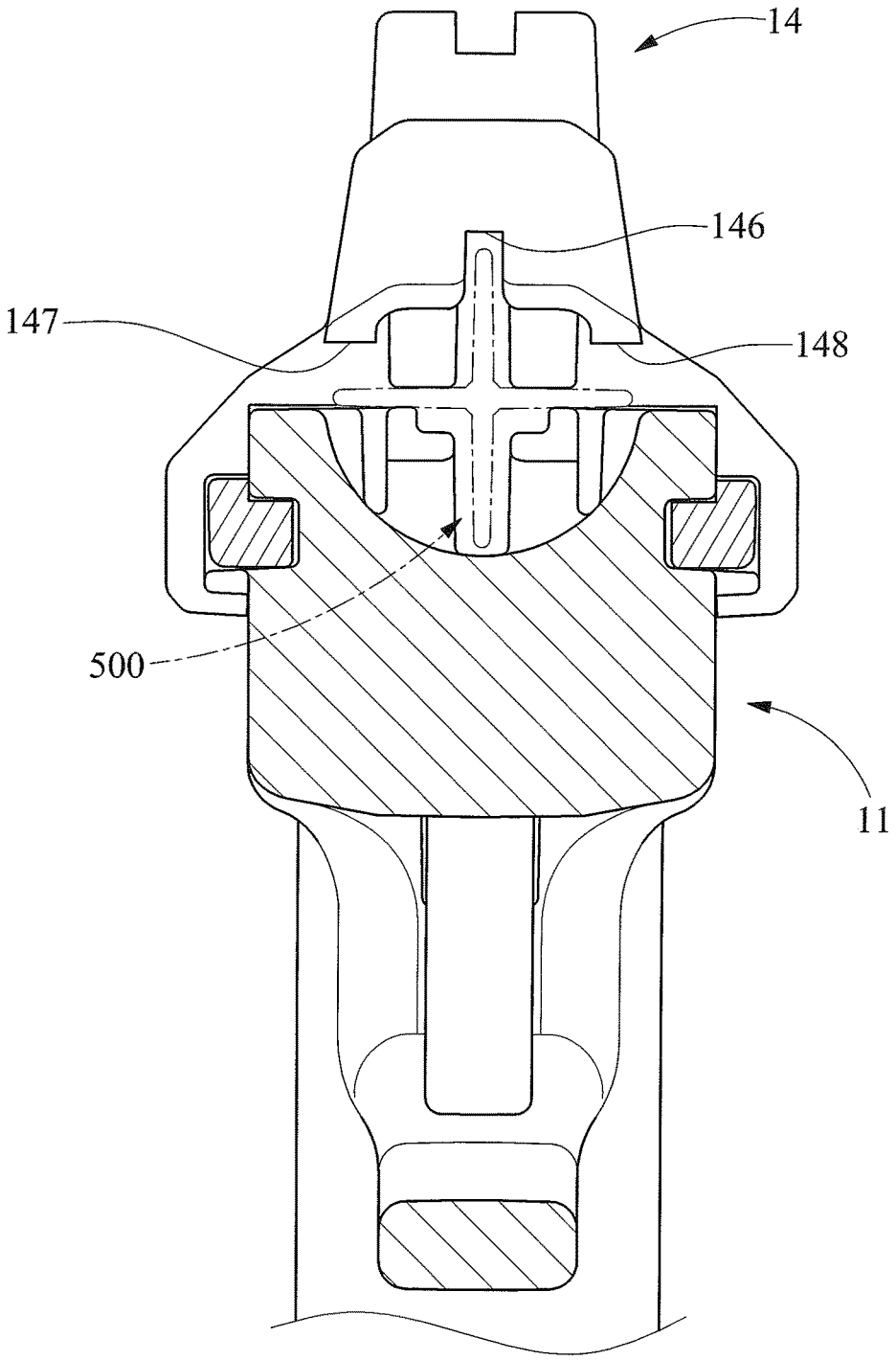
FIG. 8 is an enlarged, partial, cross-sectional view of the crossbow taken along a line 8-8 shown in FIG. 7.

The sight 14 is mounted on the barrel 11 and the handle 12. The space 149 is in communication with the flight groove 111. The dovetail groove 143 receives the dovetail 121. The shields 144 cover the longitudinal grooves 123. Each of the grooves 145 and a corresponding one of the longitudinal grooves 123 together provide a channel. Referring to FIG. 8, there are two slits 147 and 148 between the lower face of the slight 14 and the upper face of the handle 12.

Conventionally, the bow 200 is supported on a front portion of the upper face of the barrel 11. The bow 200 includes two wings 21 and a string 22. Each of the wings 21 extends from a corresponding flank of the barrel 11. The string 22 includes two ends each tied to a free end of a corresponding one of the wings 21.

The string-pulling unit 300 includes two hooks 31 and a handle 32. Each of the hooks 31 includes a shank, a barb 311 formed at an end of the shank, and a rib 312 formed on a flank of the shank. The elongated bodies of the hooks 31 extend parallel to each other. The handle 32 is connected to another end of the shank of each of the hooks 31.

The shank of each of the hooks 31 is movably inserted in the tunnel made by a corresponding one of the longitudinal grooves 123 and a corresponding one of the grooves 145. In specific, the rib 312 of each of the hooks 31 is movably inserted in a corresponding of the longitudinal grooves 123 while a portion of the shank of each of the hooks 31 is movably inserted in a corresponding one of the grooves 145. Now, the shank of each of the hooks 31 is kept between a corresponding flank of the handle 12 and a corresponding one of the shields 144. Thus, the string-pulling unit 300 is smoothly movable on the supporting unit 100. A force can be exerted on the handle 32 to move the string-pulling unit 300 backward on the supporting unit 100.

Referring to FIGS. 1 through 5, the trigger unit 41 includes a trigger 411, a plate 412, and a trigger-biasing spring 413. The trigger 411 is substantially inserted in the slot 122, with an end pivotally connected to the handle 12 and another end located out of the slot 122. The trigger 411 can be pivoted between a holding position (FIG. 5) and a releasing position (FIG. 6). In the releasing position, the trigger 411 pushes the string 22 out of the transverse groove 124.

The plate 412 is located in the slot 122. The plate 412 and the handle 12 are preferably made in one piece.

The trigger-biasing spring 413 is compressed between the trigger 411 and the plate 412. Thus, trigger-biasing spring 413 biases the trigger 411 to the holding position (FIG. 5).

Figure 3:
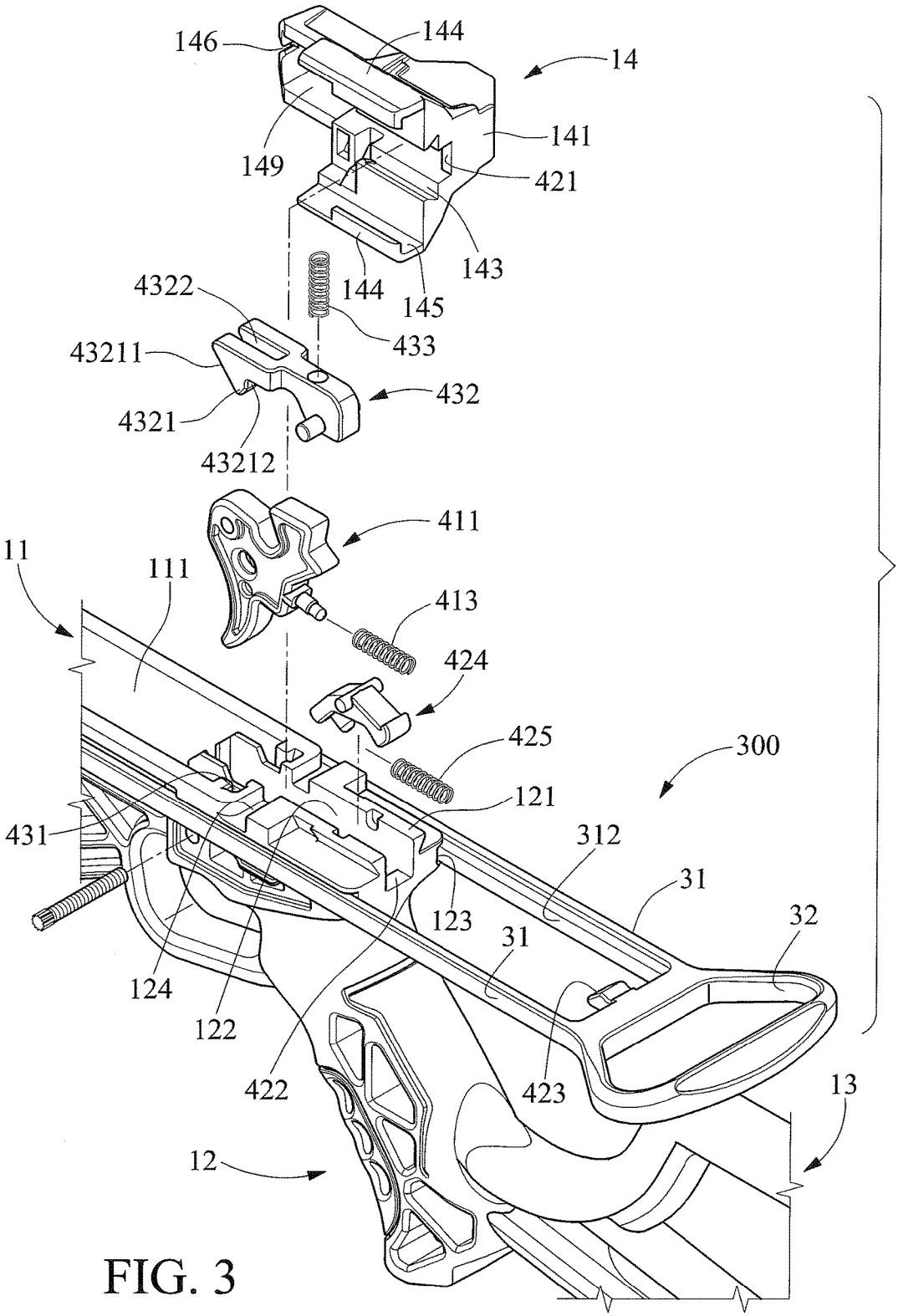
FIG. 3 is an enlarged, partial, exploded view of the crossbow shown in FIG. 1.
Figure 4:
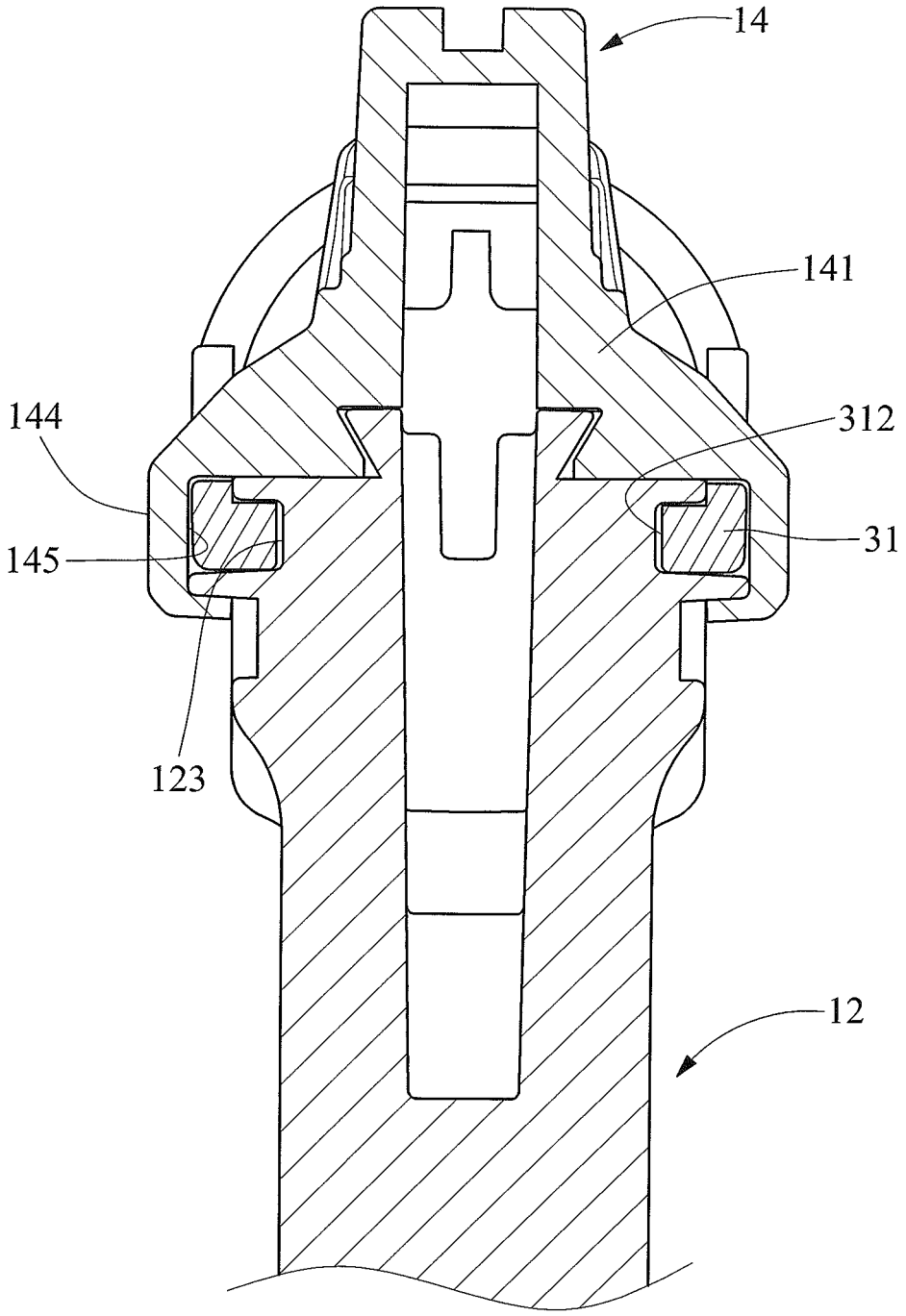
FIG. 4 is an enlarged, partial, cross-sectional view of the crossbow taken along a line 4-4 shown in FIG. 2.
Figure 5:
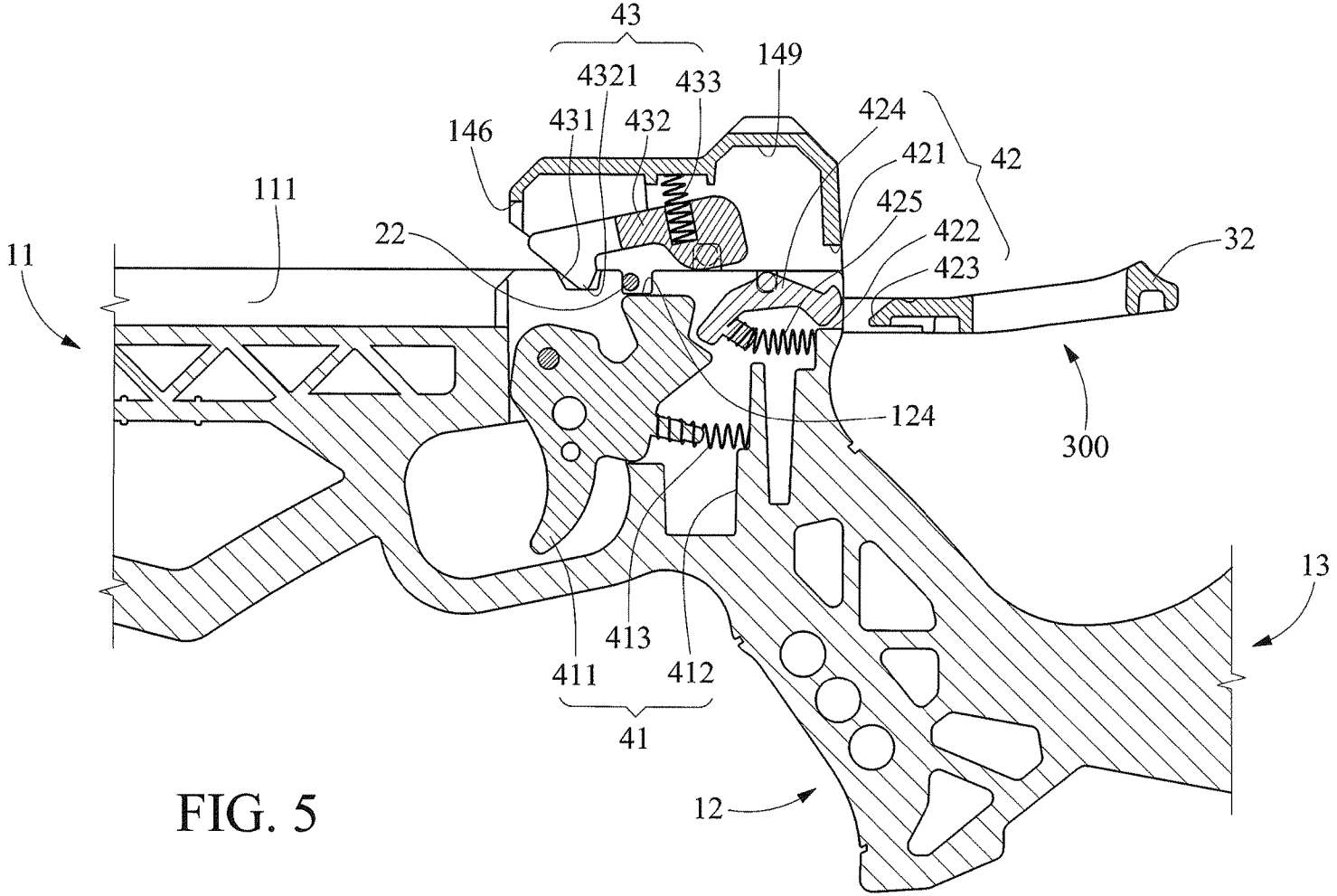
FIG. 5 is another partial, cross-sectional view of the crossbow shown in FIG. 2.
Figure 6:
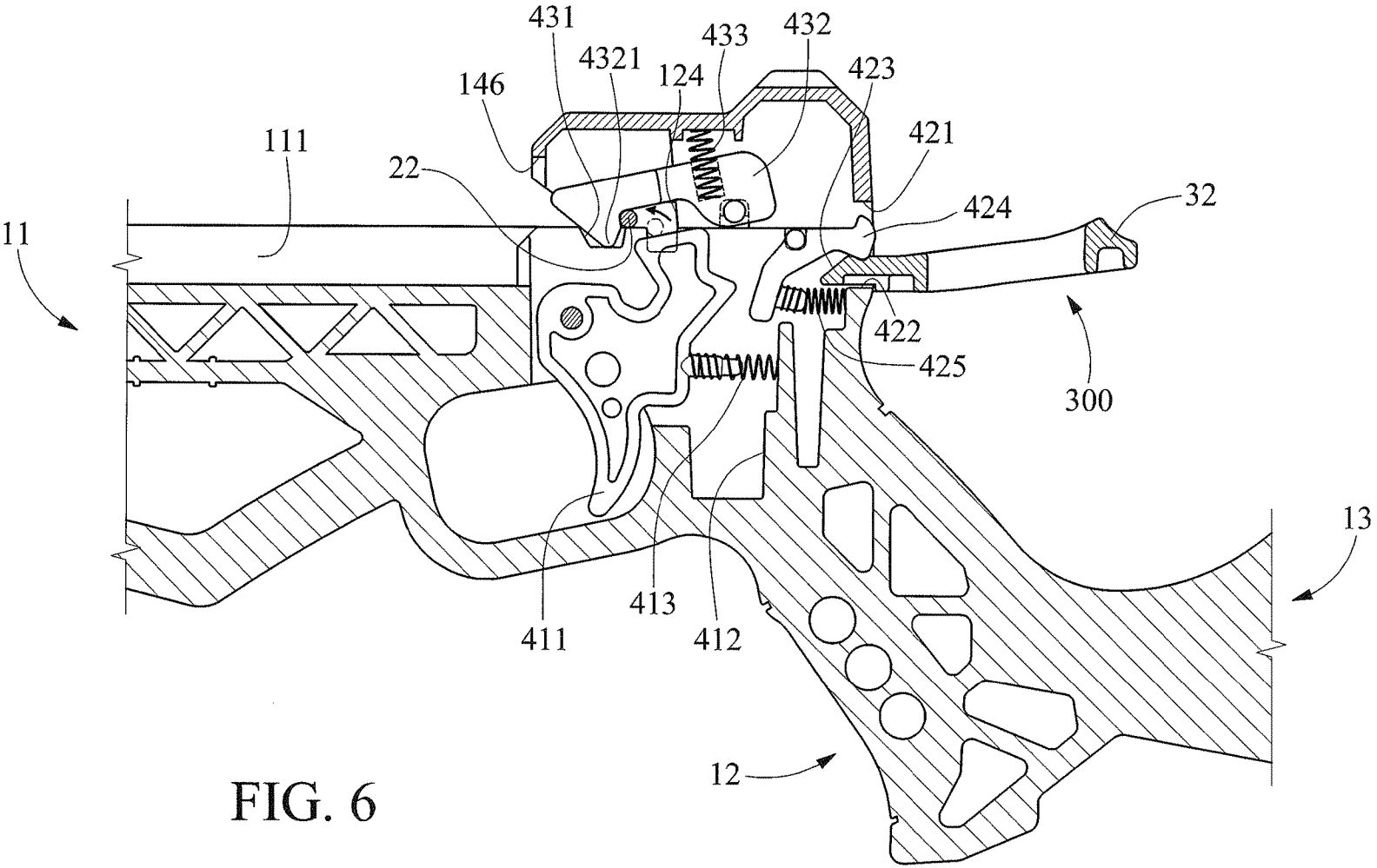
FIG. 6 is an enlarged, partial, cross-sectional view of the crossbow in another position than shown in FIG. 5.

Referring to FIGS. 3, 5 and 6, the primary security unit 42 includes an unlocking window, a pusher 423, a lock 424 and a lock-biasing spring 425. The unlocking window is made in a rear portion of the block 141. The unlocking window consists of two cutouts 421 and 422. The cutout 421 is made in the block 141, in communication with the space 149 and the dovetail groove 143. The cutout 422 is made in a rear face of the upper portion of the handle 12, in communication the slot 122.

The pusher 423 is formed on or connected to or the handle 32 corresponding to the unlocking window, which consists of the cutouts 421 and 422.

The lock 424 is inserted in the slot 122. The lock 424 includes an axle (not numbered) formed with two ends inserted in two recesses (not numbered) made in the upper portion of the handle 12, thereby pivotally connecting the lock 424 to the upper portion of the handle 12. The restraint 432 can be pivoted between a locking position (FIG. 5) and an unlocking position (FIG. 6). In the locking position, the lock 424 interferes with the trigger 411 to keep the trigger 411 in the holding position.

The lock-biasing spring 425 is compressed between an internal portion of the handle 12 and the lock 424. Thus, the lock-biasing spring 425 biases the lock 424 toward the locking position (FIG. 5). A portion of the lock-biasing spring 425 is preferably fitted on a portion of the lock 424.

Referring to FIGS. 3, 5 and 6, the security unit 43 includes two recesses 431, a restraint 432 and a restraint-biasing spring 433. The two recesses 431 are made in the upper portion of the handle 12, in front of the transverse groove 124.

The restraint 432 includes two hooks (not numbered) extending from a shank (not numbered). The hooks of the restraint 432 are separated from each other by a slit 4322. Each of the hooks of the restraint 432 includes a barb 4321 that is formed with an inclined face 43211 and a shoulder 43212. The hooks of the restraint 432 are inserted in the slot 122 via the unlocking window. The shank is formed with two bosses (not numbered) inserted in two recesses (not numbered) made in the handle 12, thereby pivotally connecting the restraint 432 to the handle 12. The restraint 432 can be pivoted between a blocking position (FIG. 5) and an unblocking position (FIG. 6).

The restraint-biasing spring 433 is compressed between an internal portion of the sight 14 and the restraint 432. Thus, the restraint-biasing spring 433 biases the restraint 432 toward the blocking position (FIG. 5).

In the blocking position, the barbs 4321 of the restraint 432 are inserted in the recesses 431 (FIG. 5). Thus, the restraint 432 will block the spring string 22 if the string 22 is released from the transverse groove 124 by mistake.

Figure 7:
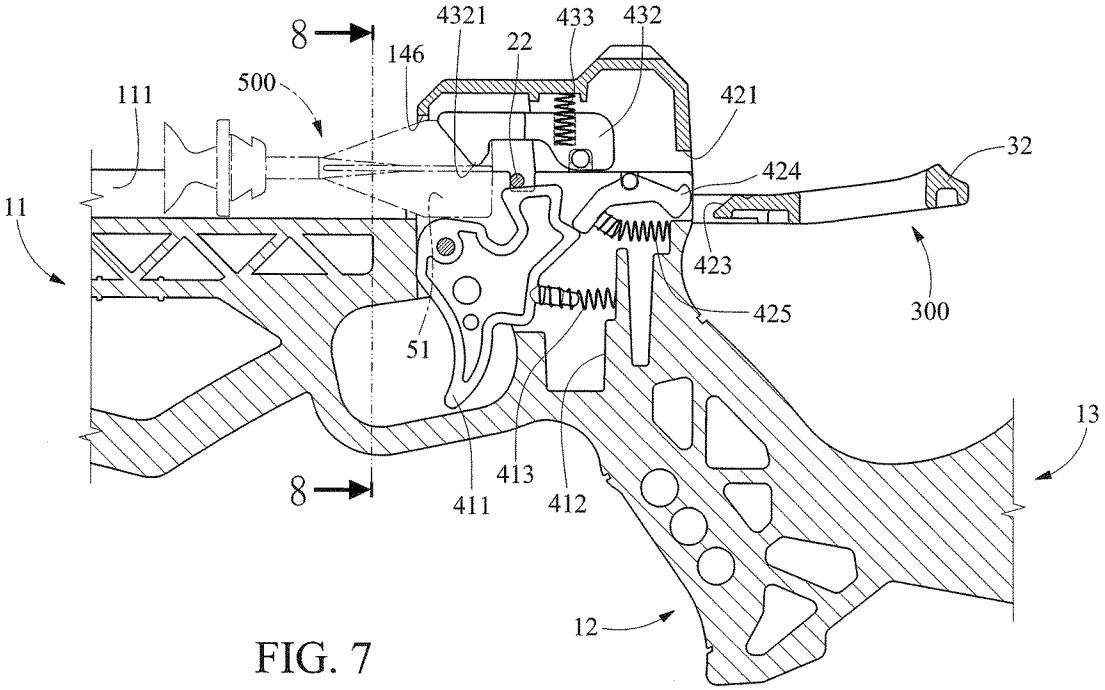
FIG. 7 is an enlarged, partial, cross-sectional view of the crossbow in another position than shown in FIG. 6.

Referring to FIG. 7, to load a bolt 500 that is formed with an empennage 51, the empennage 51 slides on the inclined faces 43211 of the barbs 4321 of the restraint 432, thereby pivoting the restraint 432 to the unblocking position and further compressing the restraint-biasing spring 433. The restraint-biasing spring 433 presses the barbs 4321 of the restraint 432 on the empennage 51 of the bolt 500, thereby keeping the bolt 500 in position.

Referring to FIGS. 1 to 5, a user can operate the handle 32 to move the hooks 31 of the string-pulling unit 300 backward to the stock 13 along the supporting unit 100. In this process, the hooks 31 of the barb 311 hook and hence move the string 22 into the transverse groove 124. The user can push the string-pulling unit 300 forward to the original position after the string 22 is inserted in the transverse groove 124 of the string 22.

The primary security unit 42 is actuated when the handle 32 is moved rearward. The pusher 423 of the primary security unit 42 is moved out of the sight 14 via the unlocking window, which consists of the cutouts 421 and 422. The pusher 423 is moved away from an end of the lock 424. The lock-biasing spring 425 is allowed to pivot the lock 424 to the locking position. In an attempt to pivot the trigger 411 of the trigger unit 41, a portion of the trigger 411 will be abutted against another end of the lock 424, i.e., the trigger 411 cannot be pivoted.

To disable the primary security unit 42, the string-pulling unit 300 is pushed forward. The pusher 423 of the primary security unit 42, which is connected to the handle 32, is pushed into the sight 14 through the unlocking window. The lock 424 is pivoted to the unlocking position from the locking position by the pusher 423, and the lock-biasing spring 425 is further compressed. The lock 424 does not interfere with the trigger 411.

The secondary security unit 43 is actuated when the crossbow is not properly loaded with a bolt 500. The restraint-biasing spring 433 of the security unit 43 keeps the restraint 432 in the blocking position where the barbs 4321 of the restraint 432 are inserted in the recesses 431. When the string 22 is moved out of the transverse groove 124, the string 22 will be blocked by the shoulders 43212 of the barbs 4321 of the restraint 432. The secondary security unit 43 is in operation in addition to the primary security unit 42.

The user can intentionally keep the string-pulling unit 300 in the rear position before everything is ready. The pusher 423 of the primary security unit 42 is located out of the sight 14 through the unlocking window. The lock-biasing spring 425 is allowed to keep the lock 424 in the locking position, thereby preventing the pivoting of the trigger 41.

The security unit 42 is automatically disabled as the crossbow is properly loaded with a bolt 50. Referring to FIGS. 7 and 8, the user can move the bolt 500 into the space 149 of the sight 14 and the slot 122 of the handle 12 along the flight groove 111. In the loading of the bolt 50, the empennage 51 of the bolt 500 is moved into the space 149 via the slits 146, 147 and 148. The empennage 51 slides along the inclined face 43211 of the barb 4321 of the restraint 432 of the security unit 43. Thus, the empennage 51 moves the restraint 432 to the unblocking position out of the two recesses 431, and further compresses the restraint-biasing spring 433.

The restraint-biasing spring 433 presses the barbs 4321 of the restraint 432 on the empennage 51 of the bolt 500. Thus, the bolt 500 is kept in position particularly when the crossbow is pointed downward.

Moreover, the empennage 51 of the bolt 500 can only be moved into the space 149 via the slits 146, 147 and 148. The length of the slit 146 makes sure that only a bolt with a desired empennage can be loaded onto the crossbow.

Figure 9:
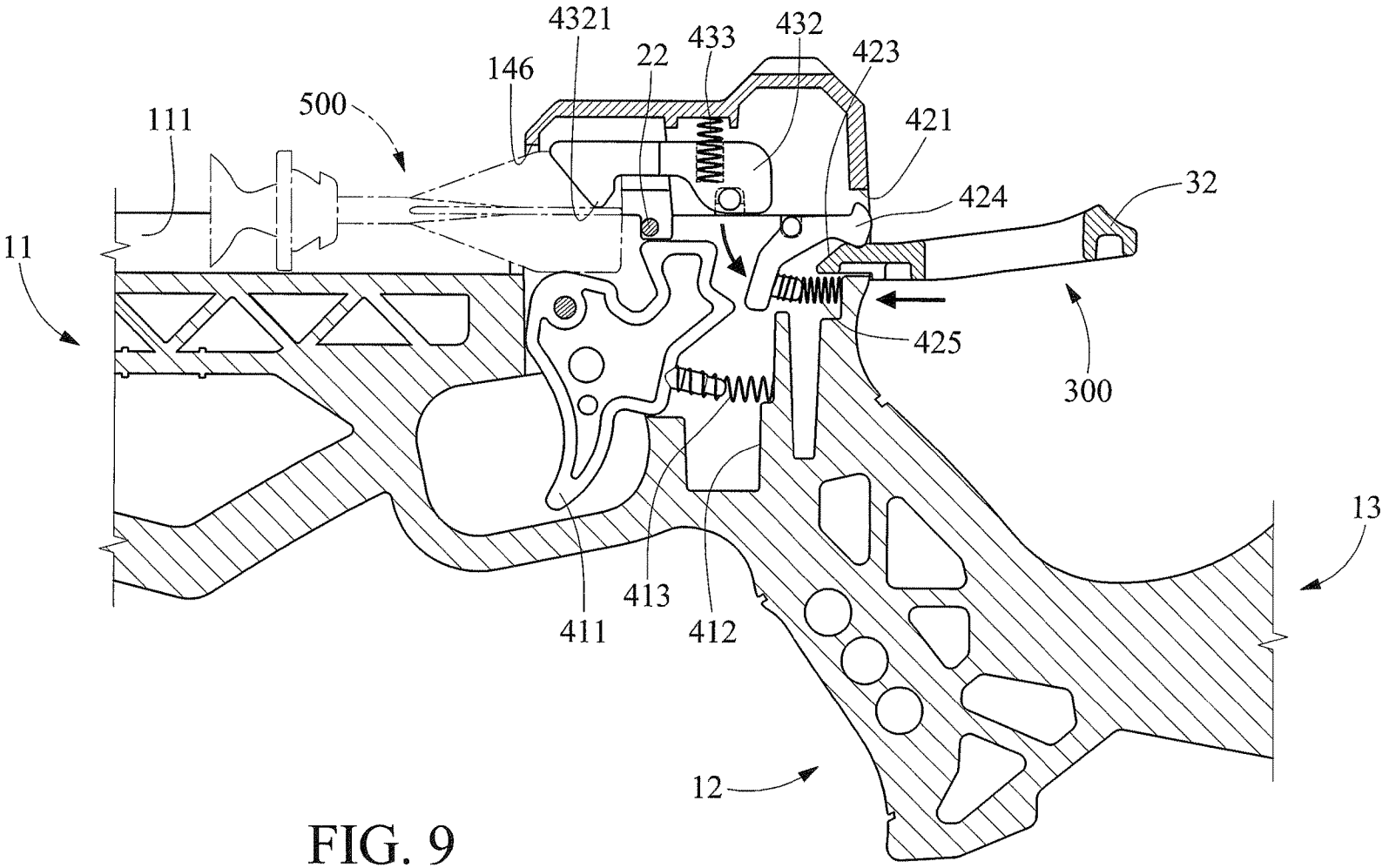
FIG. 9 is an enlarged, partial, cross-sectional view of the crossbow in another position than shown in FIG. 7.
Figure 10:
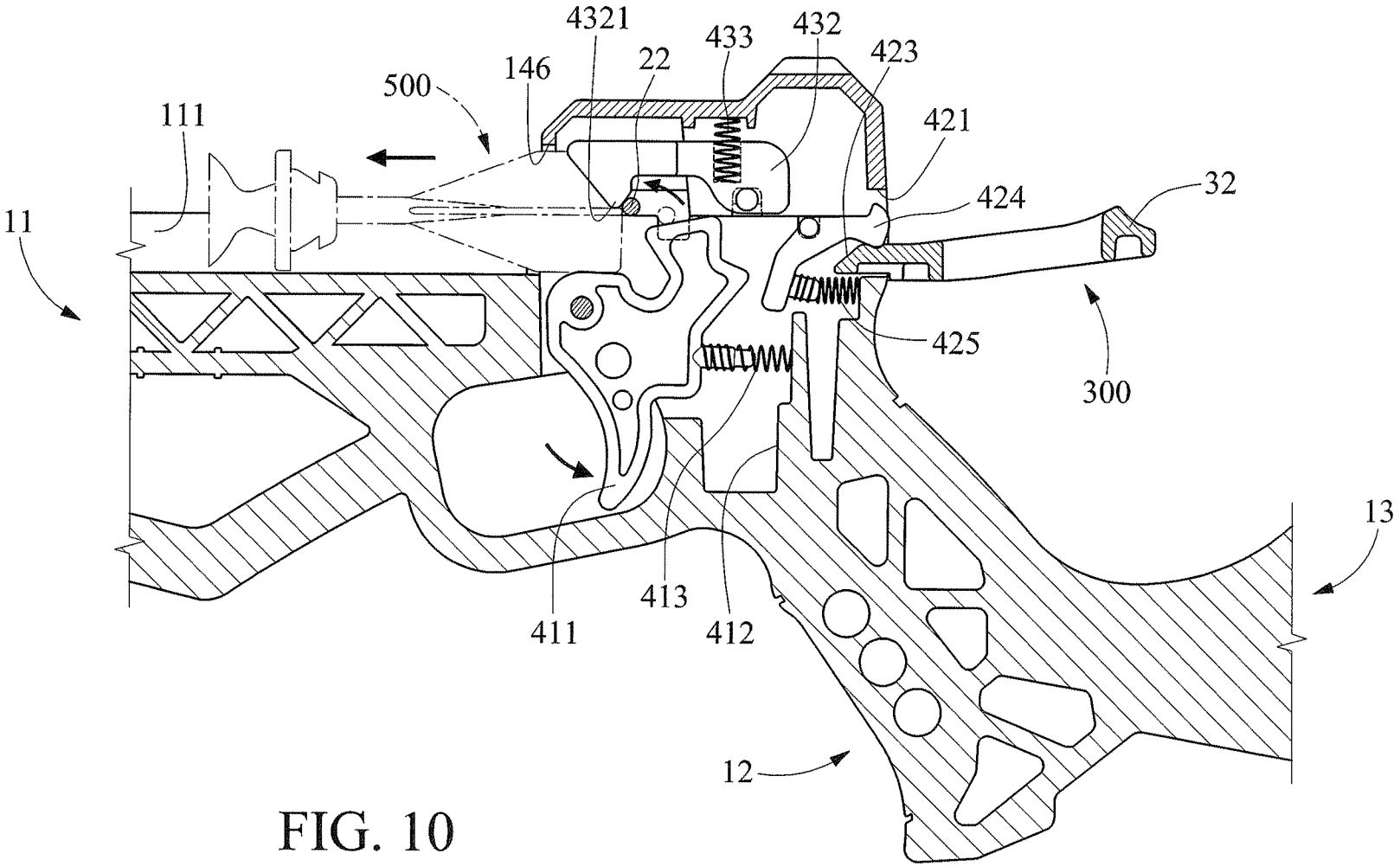
FIG. 10 is an enlarged, partial, cross-sectional view of the crossbow in another position than shown in FIG. 9.
Figure 11:
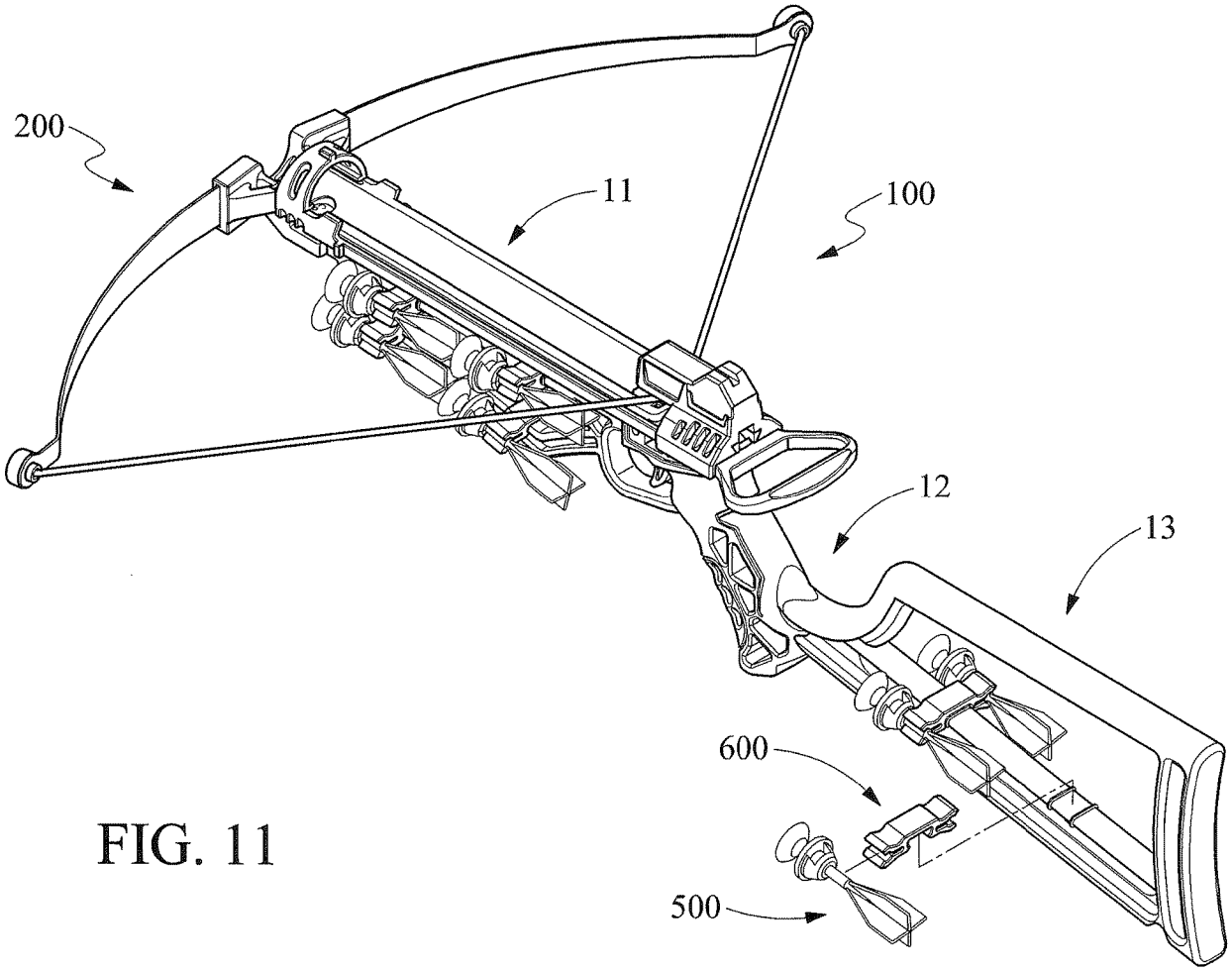
FIG. 11 is a perspective view of a crossbow according to the second embodiment of the present invention.
Figure 12:
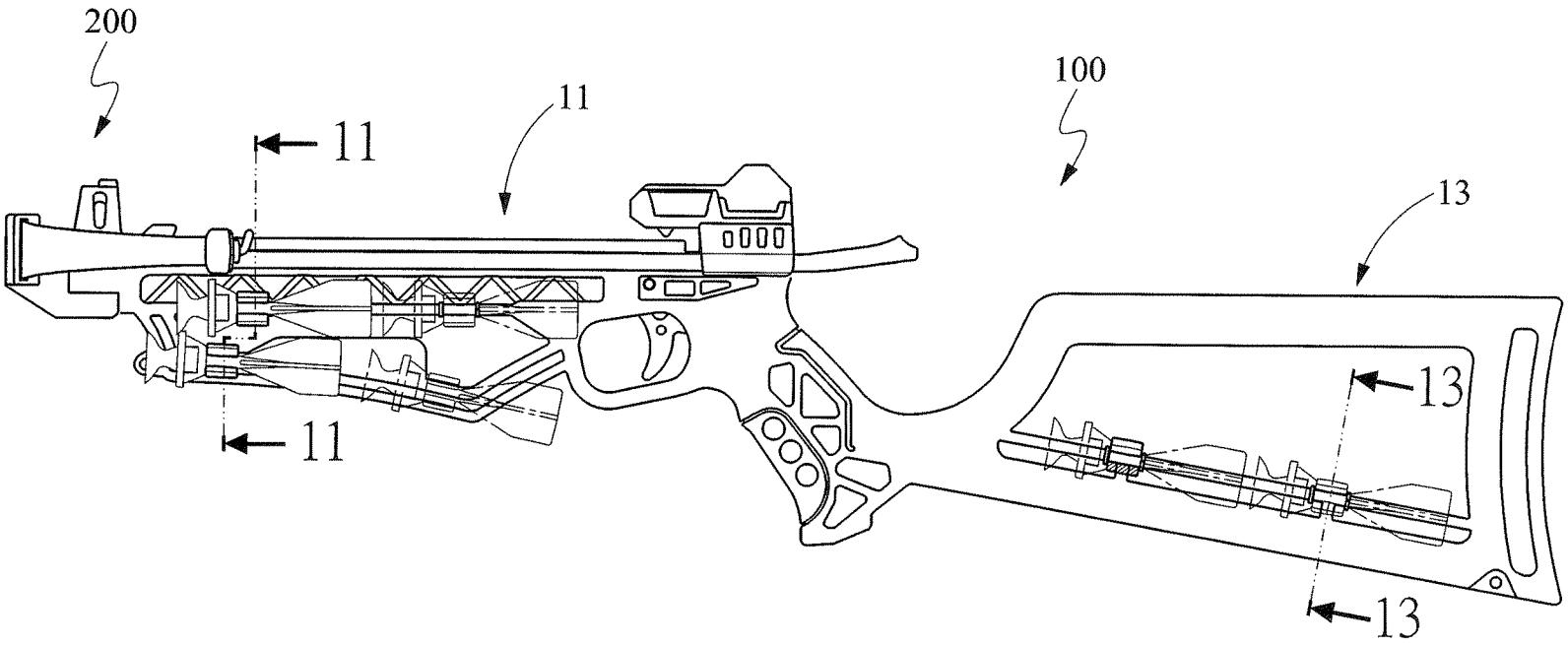
FIG. 12 is a side view of the crossbow shown in FIG. 11.
Figure 13:
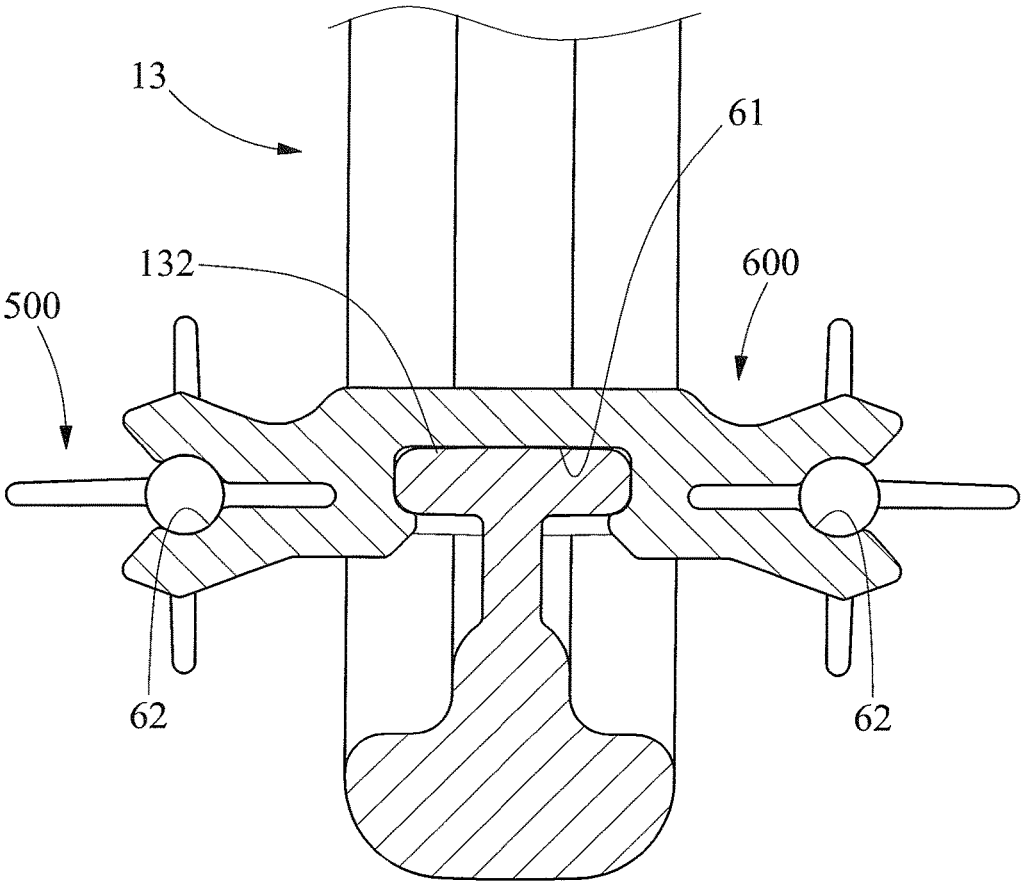
FIG. 13 is an enlarged, partial, cross-sectional view of the crossbow taken along a line 13-13 shown in FIG. 12.
Figure 14:
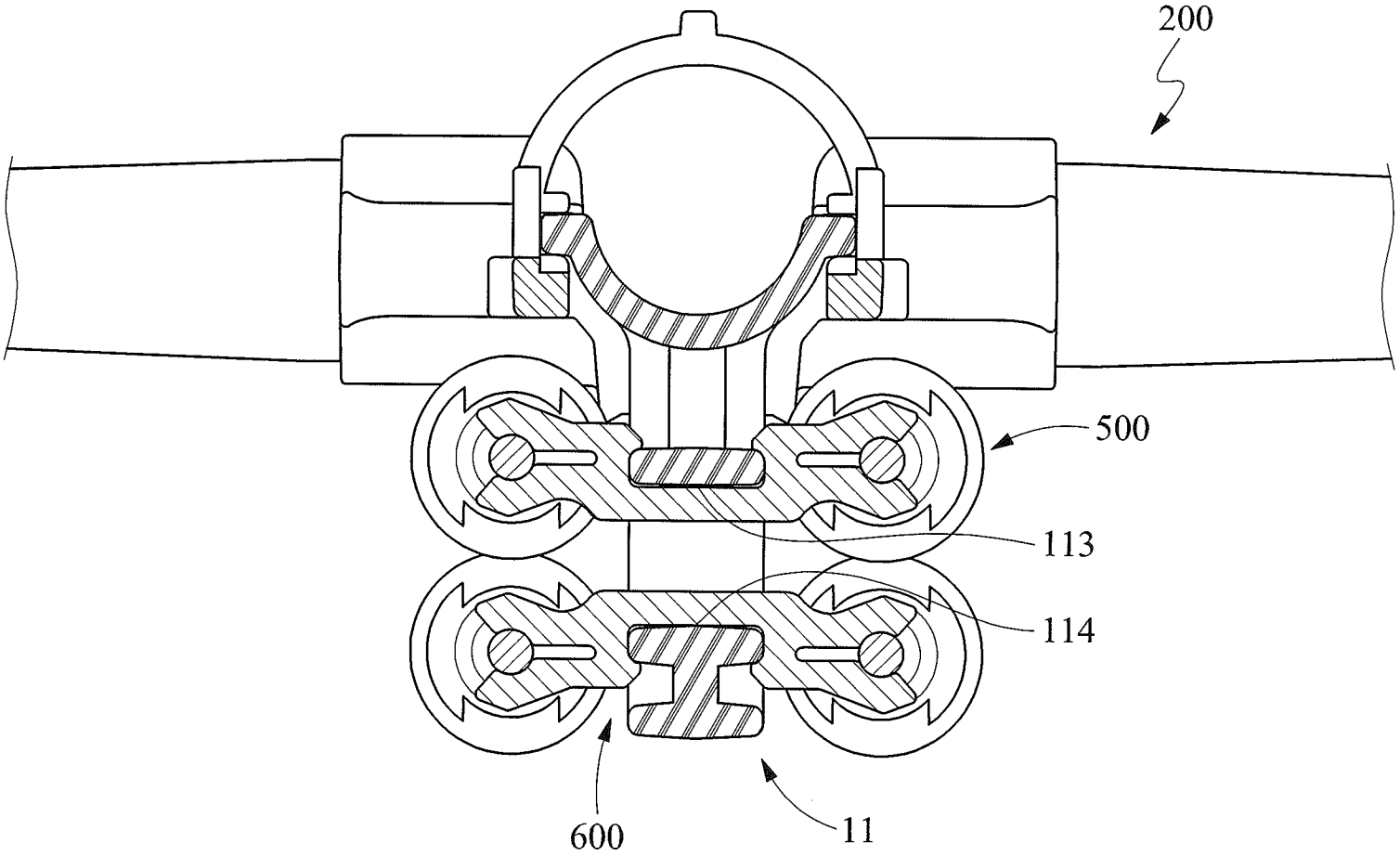
FIG. 14 is an enlarged, partial, cross-sectional view of the crossbow taken along a line 14-14 shown in FIG. 12.

Referring to FIGS. 9 and 10, the user can return the string-pulling unit 300 to the original position, the pusher 423 of the security unit 42 is inserted in the space 149 of the unlocking window. The pusher 423 pushes the lock 424 to the unlocking position (FIG. 9) from the locking position (FIG. 7), and the primary security unit 42 is disabled.

Now, the user can pivot the trigger 411 to the releasing position (FIG. 10) from the holding position (FIG. 9) while further compressing the trigger-biasing spring 413. Finally, the trigger 411 pushes the string 22 out of the transverse groove 124. The string 22 is allowed to drive the bolt 500 away from the supporting unit 100 along the flight groove 111.

Referring to FIGS. 11 to 14, there is a crossbow according to a second embodiment of the present invention. The second embodiment is identical to the first embodiment except for including several clips 600 each for holding several bolts 500. Each of the clips 600 includes a groove 61 and preferably two lateral cutouts 62. The groove 61 is made in compliance with the profile of at least one portion of the supporting unit 100 such as the strips 113 and 114 of the barrel 11 and the frame 132 of the stock 13. The groove 61 can receive the strip 113 or 114 or the frame 132. Each cutout 62 is made in compliance with the profile of the bolt 500. Each cutout 62 can receive a bolt 500. Hence, the bolts 500 can be carried together with the crossbow due to the use of the clips 600.

The present invention has been described via the detailed illustration of the preferred embodiments. Those skilled in the art can derive variations from the preferred embodiment without departing from the scope of the present invention. Therefore, the preferred embodiment shall not limit the scope of the present invention defined in the claims.

The invention claimed is:

1. A crossbow comprising a supporting unit, a bow supported on the supporting unit, a string-pulling unit pivotally connected to the supporting unit and adapted for pulling the bow, a trigger unit and connected to the supporting unit adapted for restraining the bow, and a primary security unit adapted for restraining the trigger unit, wherein the primary security unit comprises:

a lock movable between a locking position and an unlocking position, wherein the trigger unit is prevented from pivoting when the lock is in the unlocking position;

a lock-biasing spring for pivoting the lock to the locking position; and a pusher connected to the string-pulling unit and movable relative to the supporting unit between a first position and a second position, wherein the pusher keeps the lock in the unlocking position when the pusher is in the first position, and wherein the pusher allows the lock-biasing spring to move the lock to the locking position when the pusher is in the second position.

2. The crossbow according to claim 1, wherein the supporting unit comprises:

a barrel;

a handle connected to the barrel; and a sight connected to the handle, and made with a space for containing the trigger unit and the primary security unit and an unlocking opening through which the pusher is movable into the space.

3. The crossbow according to claim 2, wherein the sight further comprises a slot for communicating the space with the unlocking window.

4. The crossbow according to claim 2, wherein the handle comprises a handle dovetail formed thereon, and wherein the sight comprises a sight dovetail for receiving the handle dovetail to connect the sight to the handle.

5. The crossbow according to claim 4, wherein the handle further comprises two longitudinal grooves, and wherein the string-pulling unit comprises two hooks each formed with a shank movably inserted in a corresponding one of the two longitudinal grooves.

6. The crossbow according to claim 5, wherein each of the two hooks further comprises a rib longitudinally formed on a side of the shank and movably inserted in the corresponding one of the two longitudinal grooves.

7. The crossbow according to claim 6, wherein the sight comprises two shields each covering an opposite side of the shank of a corresponding one of the two hooks.

8. The crossbow according to claim 7, wherein each of the two shields comprises a groove for receiving the shank of the corresponding one of the two hooks.

9. The crossbow according to claim 5, wherein the string-pulling unit further comprises a handle connected to the two hooks.

10. The crossbow according to claim 2, wherein the bow comprises a string, and wherein the handle further comprises a transverse groove for receiving the string.

11. The crossbow according to claim 10, further comprising a secondary security unit inserted in and connected to the sight, and movable between an unblocking position and a blocking position for blocking the string that escapes from the transverse groove.

12. The crossbow according to claim 11, wherein the secondary security unit comprises:

two recesses made in the handle near the transverse groove;

a restraint pivotally connected to the handle between the blocking position and the unblocking position; and a restraint-biasing spring for biasing the restraint to the blocking position.

13. The crossbow according to claim 12, wherein the restraint comprises a barb for hooking the string.

14. The crossbow according to claim 13, wherein the barb comprises a slit, and wherein the sight comprises a slit so that an empennage of a bolt is movable into the sight through the slits of the barb and of the sight.

15. The crossbow according to claim 1, further comprising at least one clip for holding at least one bolt thereto.

16. The crossbow according to claim 15, wherein the at least one clip comprises a groove for receiving a portion of the crossbow.

17. The crossbow according to claim 16, wherein the barrel further comprises at least one strip inserted in the groove.

18. The crossbow according to claim 17, wherein the supporting unit further comprises a stock extending from the handle, and wherein the stock comprises a strip 1 inserted in the groove.

19. The crossbow according to claim 15, wherein the at least one clip comprises at least one cutout for receiving a portion of the at least one bolt.

* * * * *